United States Patent [19]

Hellwege et al.

[11] Patent Number: 4,543,582

[45] Date of Patent: Sep. 24, 1985

[54] ANTENNA FOR A SUBMARINE VESSEL

[75] Inventors: Dieter Hellwege, Mittelnkirchen; Peter Steffen, Sudweyhe; Wolfgang Waldhelm, Achim, all of Fed. Rep. of Germany

[73] Assignee: U.S. Philips Corporation, New York, N.Y.

[21] Appl. No.: 584,411

[22] Filed: Feb. 28, 1984

Related U.S. Application Data

[63] Continuation of Ser. No. 295,871, Aug. 24, 1981, abandoned.

[30] Foreign Application Priority Data

Aug. 22, 1980 [DE] Fed. Rep. of Germany ..... 3031694

[51] Int. Cl.[4] ..... H01Q 1/34

[52] U.S. Cl. ..... 343/710; 343/742

[58] Field of Search ..... 343/709, 710, 741, 742

[56] References Cited

U.S. PATENT DOCUMENTS

| | | | |
|---|---|---|---|
| 1,708,071 | 4/1929 | Willoughby et al. | 343/710 |
| 2,781,512 | 2/1957 | Robinson | 343/708 |
| 3,568,202 | 3/1971 | Fitton et al. | 343/709 |
| 3,961,589 | 6/1976 | Lombardi | 343/709 |

FOREIGN PATENT DOCUMENTS

| | | | |
|---|---|---|---|
| 367278 | 2/1932 | United Kingdom | 343/709 |

*Primary Examiner*—Eli Lieberman

*Attorney, Agent, or Firm*—Thomas A. Briody; William J. Streeter; Leroy Eason

[57] ABSTRACT

For radio communication with submarine vessels frequency ranges with very low frequencies are used. Even at these frequencies the penetration depth in salt water is only approximately 10 to 20 meters. In order to improve the signal noise ratio or to extend the submerging depth use is made of buoy antennas connected to the submarine vessel by a cable. In order to improve the manoeuvrability of the submarine vessel and to avoid the use of an active control system in the antenna, the antenna is constructed as a torpedo-like hollow body, which at the trailing part is equipped with two hydrofoils resembling a horizontal tail unit, which hydrofoils interconnect the top and bottom of the body to each other as an open arc. Both in the floating body and in the hydrofoils a loop of a crossed-loop antenna is incorporated, which loops are tuned in order to increase the sensitivity. Signal transmission to the submarine vessel is effected via an optical fibre guide, which also transmits the traction force.

5 Claims, 2 Drawing Figures

ANTENNA FOR A SUBMARINE VESSEL

This is a continuation of application Ser. No. 295,871, filed Aug. 24, 1981, now abandoned.

BACKGROUND OF THE INVENTION

1. Field of the Invention

The invention relates to an antenna for a submarine vessel, which antenna is arranged in a floating body and is connected to the submarine vessel via a connecting element which transmits the information received by the antenna.

2. Description of the Prior Art

For radio communication with a submerged submarine vessel only extremely low frequencies can be employed, as is known, because the damping by the seawater is too high at higher frequencies. In addition, the penetration depth for frequencies in the range from 10 to 20 kHz is only approximately 10 to 20 meters depending on the salinity and temperature. Furthermore, at such low frequencies the screening effect of the hull of the vessel is so small that interference from the interior of the vessel can reach the exterior and is superimposed on the desired signal as noise.

Therefore use is made of antennas which are remote from the vessel, which are located at a sufficient distance from the noise zone radiated by the submarine vessel and which also enable the submarine vessel to submerge to a greater depth, the remote antenna being maintained underneath the water surface within range of the penetration depth of the frequencies to be received. Such an antenna in the form of a trailing buoy of the kind mentioned in the opening paragraph is mentioned in the paper by Dupont-Nivet "Télécommunications avec les sous-marines" in Défense nationale = F = 32 (1976) 1, Jan., pages 63–74. Such a buoy antenna, however, is comparatively large and hydrodynamically unfavourable, which limits the manoeuvrability of the submarine vessel and permits ready detection of the buoy antenna by sonar. Furthermore, in general such a buoy antenna cannot be maintained at a substantially constant depth at varying speeds of the vessel without the use of an active control system.

SUMMARY OF THE INVENTION

It is an object of the invention to provide an antenna for a submarine vessel, which presents a minimal hydrodynamic resistance and which without the use of an active control system remains at a substantially equal depth at varying speeds. According to the invention, this problem is solved in that the floating body has a torpedo-like shape and is provided with two hydrofoil-like projections, which interconnect the top and bottom of the trailing part of the floating body on both sides with an open arc, and that the connecting element is connected to the bottom of the leading part of the floating body. Such an antenna has a hydrodynamically favourable shape and for a specific point of attachment of the connecting cable the hydrofoil projections increase the buoyancy produced by the flow to such an extent that the floating body remains at substantially equal depth at different speeds.

An improvement of the hydrodynamically favourable shape can be obtained in that in plan view the hydrofoil-like projections are arrow-shaped in the direction of foating. A hydrodynamically favorable shape is essential because this determines the minimum strength of the connecting element, which in the case of a higher hydrodynamic resistance of the antenna should obviously be thicker, which in turn would give rise to an increased hydrodynamic resistance.

The antenna itself may be constructed in various ways. In one embodiment of the invention the floating body at least for a substantial part consists of an electrically conductive material and is constructed as a notch antenna. Notch antennas are long known. See, for example "Proc. IEE" vol. 102, part B, 1955, pages 211–218 and "IRE Trans." AP 6, 1958, pages 35–43.

Since such a metallic floating body would be easy to detect, other antenna constructions may be more effective, especially for military submarine vessels. A further embodiment of the invention is therefore characterized in that the antenna is constructed as a crossed-loop antenna and the floating body consists of an electrically insulating material, the one loop being arranged near the outer skin of the floating body in a perpendicular plane through the axis of the floating body and the other loop being arranged in the hydrofoil-like projections, which two loops are tuned to separate predetermined frequency ranges. Suitably, such a floating body is made of a plastic and may have a dielectric constant substantially equal to that of seawater, so that it can neither be detected electrically nor by means of sonar in the case of small dimensions at long range.

Further embodiments of the invention will be defined in the sub-claims.

Embodiments of the invention will be described in more detail with reference to the drawing.

DETAILED DESCRIPTION OF THE PREFERRED EMBODIMENT

Figure 1:
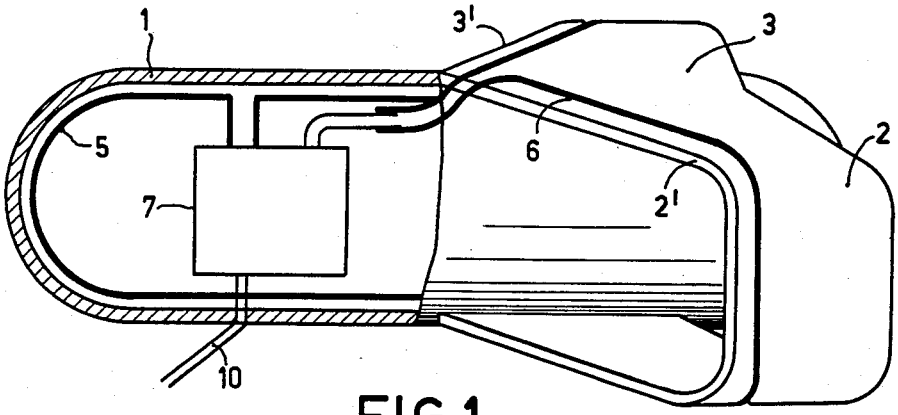
FIG. 1 is a partly cut-away perspective view of a floating body with a loop antenna.

FIG. 1, shows a torpedo-like hollow body 1, on which at the trailing part two hydrofoil-like projections 2 and 3 are arranged. The hydrofoil-like projections 2 and 3 interconnect the top and bottom of the hollow body 1 with an open arc. The projections 2 and 3 are shaped in such a way that in plan view the two leading edges 2' and 3' of projections 2 and 3 are shaped as an arrow head, which points in the direction of floating, that is to the left in the Figure. In cross-section the wall of the hydrofoils 2 and 3 may be drop-shaped, which is hydrodynamically favorable.

Near the edges 2' and 3' a metal strip 6 is arranged, which constitutes one loop of the loop antenna. The metal strip is shown to be disposed on the surface of the projections 2 and 3, but in practice it is more effective if it is incorporated in the wall of the projections. The strip continues underneath the projections and thus constitutes a single continuous conductor. Instead of the strip it is possible to employ a wire, which may also be arranged along the leading edges 2' and 3' of the projections 2 and 3 with a plurality of turns.

The other loop of the crossed-loop antenna is a conductor 5, which is axially arranged in the body 1 at the top and bottom or incorporated in the wall and thus constitutes an open conductor loop. Loop 5 may also comprise a plurality of turns. The ends of the loops 5 and 6, which enter the body 1 at the location where the projections 2 and 3 are attached to the body, are connected to a circuit 7, which is symbolically represented by a block and which will be described in more detail with reference to FIG. 2.

The output of this circuit 7 is constituted by an optical fiber guide 10, which at the same time serves as the connecting element and transmits the driving force to the entire floating-body antenna. Instead, the optical fiber guide 10 may also extend parallel to a steel cable, in which case the last-mentioned cable provides the traction.

At the frequencies specified in the foregoing the torpedo-like body 1 suitably has a length of approximately 80 to 90 cm at a diameter of approximately 20 cm. The span of the hydrofoil-like projections is approximately 50 cm. If this results in different loop areas of the two loops 5 and 6 and consequent differences in the signals from the two loops should be compensated for, this may for example be achieved by an increased number of turns of the loop 6 relative to loop 5.

Figure 2:
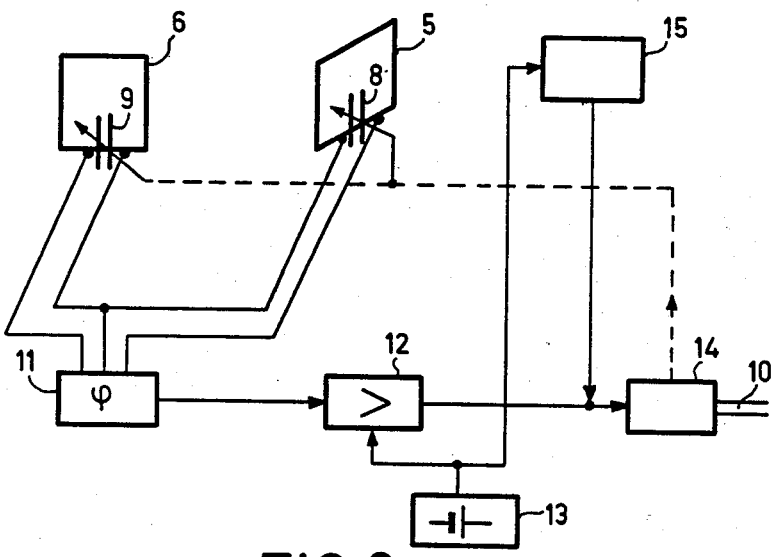
FIG. 2 shows the electrical circuit arrangement of some components of the floating antenna.

In FIG. 2 variable capacitances 8 and 9 are connected to loops 5 and 6 as tuning elements. The two loops are connected to a phase-shifting network 11, in which the signals from the two loops 5 and 6 are combined with the current phase, so that they are available on the output for application to an amplifier 12. Amplifier 12 amplifies the applied signal and controls an electro-opticalsignal transducer 14, which converts the antenna signal into an optical signal which is fed into the optical fiber guide 10. The operating voltage for the amplifier 12 is supplied by an accumulator battery 13. Thus, an additional cable for the power supply from the submarine vessel to the floating-body antenna may be dispensed with. The accumulator 13 can be charged during maintenance periods on shore or when the floating antenna is hauled back into the submarine vessel. In the last-mentioned case contacts may be arranged on the body 1, which are connected to the accumulator 13 and, when the antenna is hauled into the submarine vessel, automatically come into contact with contacts arranged on said vessel, which contacts supply a charging current, so that the accumulator 13 is automatically charged in the hauled-in condition of the antenna.

The variable capacitors 8 and 9 may be adjusted to a specific frequency range for a specific application, for example during manufacture or maintenance activities. Another possibility is to adjust the variable capacitors 8 and 9 via a signal from the submarine vessel, which signals may be applied via a separate transmission medium or also via the optical fiber guide 10. In the last-mentioned case the transducer 14 also comprises an opto-electronic transducer, which generates a signal for controlling the variable capacitors 8 and 9, for example through a motor-drive or electrically by means of variable capacitance diodes.

In the present embodiment there is further provided a pressure measuring arrangement 15 comprising a pressure transducer for generating an electric signal, which arrangement measures the water-pressure around the body 1 and converts it into a corresponding electric signal. For this purpose the pressure-measuring arrangement 15 is also powered by the battery 13 and supplies a signal to the submarine vessel via the transducer 14 and the optical fiber guide 10, for example by the use of a frequency range in the transmitted signal which is not used for the antenna, so that in the submarine vessel it is always known at which depth below the water surface the floating-body antenna is located, permitting said depth to be adjusted to the desired value by varying the length of the optical fiber guide 10 via a submarine winch arranged on the submarine vessel. For military purposes the pressure-measuring arrangement 15 may control an automatic destruction device, which is rendered operative when the water pressure is substantially zero, for example because the floating antenna has become detached, in order to prevent the detection of the antenna on the water surface under all circumstances.

What is claimed is:

1. A cross-loop antenna for a submarine vessel, comprising:
   - a floating body (1) having a torpedo-like shape and two hydrofoil-like projections (2, 3) that interconnect the top and bottom of the trailing part of said body;
   - a first antenna loop (5) arranged near the outer skin of said body in a perpendicular plane through the axis of said body;
   - a second antenna loop (6) arranged in the hydrofoil-like projections (2, 3);
   - and a connecting element (10) connected to the bottom of the leading part of said body for transmitting information received by the antenna to the submarine vessel.

2. An antenna structure as claimed in claim 1 wherein said loops are tuned to separate predetermined frequency ranges.

3. An antenna structure as claimed in claim 1 wherein said second loop (6) is arranged near the leading edges (2', 3') of the hydrofoil-like projections (2, 3).

4. An antenna structure as claimed in claim 1 further comprising switchable tuning elements (8, 9) located in said body (1), said tuning elements being connected to said loops.

5. An antenna structure as claimed in claim 4 wherein the tuning elements (8, 9) are adjusted by signals supplied from the submarine vessel via said connecting element (10).

* * * * *